US005582442A

United States Patent [19]

Nolte

[11] Patent Number: 5,582,442

[45] Date of Patent: Dec. 10, 1996

[54] LATCH ASSEMBLY AND MANUFACTURING AND PAINTING PROCESSES

[75] Inventor: Douglas A. Nolte, Owatonna, Minn.

[73] Assignee: Truth Hardware Corporation, Owatonna, Minn.

[21] Appl. No.: 529,189

[22] Filed: Sep. 15, 1995

[51] Int. Cl.[6] ..... E05C 19/10

[52] U.S. Cl. ..... 292/101; 292/DIG. 46; 292/357

[58] Field of Search ..... 292/101, 337, 292/DIG. 46, DIG. 53, 357; 70/95, 96, 97, 98, 99, 100

[56] References Cited

U.S. PATENT DOCUMENTS

| | | | |
|---|---|---|---|
| 2,990,208 | 6/1961 | Miller | 70/97 |
| 3,046,776 | 7/1962 | Marotto et al. | 70/97 |
| 3,162,472 | 12/1964 | Rust | 292/114 |
| 3,811,718 | 5/1974 | Bates . | |
| 3,827,738 | 8/1974 | Dushane, Jr. | 292/128 |
| 3,877,739 | 4/1975 | Cowen | 292/101 |
| 3,884,514 | 5/1975 | Praska | 292/11 |
| 4,068,874 | 1/1978 | Fleming et al. | 292/128 |
| 4,186,952 | 2/1980 | Glass . | |
| 4,362,328 | 12/1982 | Tacheny et al. . | |
| 4,436,328 | 3/1984 | Chernosky . | |
| 4,621,847 | 11/1986 | Paulson et al. . | |
| 4,736,972 | 4/1988 | Mosch . | |
| 4,754,624 | 7/1988 | Fleming et al. . | |
| 4,801,164 | 1/1989 | Mosch . | |
| 4,813,725 | 3/1989 | Mosch . | |
| 4,973,091 | 11/1990 | Paulson et al. . | |
| 5,069,492 | 12/1991 | Tatham | 292/85 |
| 5,092,144 | 3/1992 | Fleming et al. | 70/95 |
| 5,161,839 | 11/1992 | Piltingsrud et al. | 292/241 |

OTHER PUBLICATIONS

Truth brochure "Hard Working Hardware for Sliding Patio Doors" (1991).
Technology Group News Release brochure (undated).
Unknown Handle Origin (undated).
Hoppe brochure "Sliding door handle sets", p. 15 (undated).
Unknown Handle Origin "Vinyl Sliding Patio Doors" (undated).
Unknown Handle Origin "Sliding door handles" (undated).
Hardware Technologies Brochure "Effortless Efficient and Attractive" (undated).
Fullex U.S. Inc. Brochure "Multi-Point sliding patio door lock" (undated).
Sash Controls Brochure "Curio Brass Handle Set" (undated).

*Primary Examiner*—Steven N. Meyers
*Assistant Examiner*—Donald J. Lecher
*Attorney, Agent, or Firm*—Wood, Phillips, VanSanten, Clark & Mortimer

[57] ABSTRACT

A latch assembly and process for manufacturing such an assembly and process for painting an assembly with a pivoting member are disclosed. The latching assembly comprises a body, a latch moveable between open and closed positions, and a thumb turn mounted for pivotal movement in the body. The thumb turn includes a cylindrical boss mounted for rotation in the body about a central axis of rotation, and a lever arm extending radially outwardly from the central axis of rotation of the cylindrical boss to a free end exposed outside of the body. A plurality of resilient arms having free hook ends engage the cylindrical boss to hold the cylindrical boss in the body while allowing for rotational movement of the cylindrical boss with pivotal movement of the lever arm. The free hook ends are held in a separate position which prevents rotational movement during the painting step of the manufacturing process.

23 Claims, 4 Drawing Sheets

FIG. 4
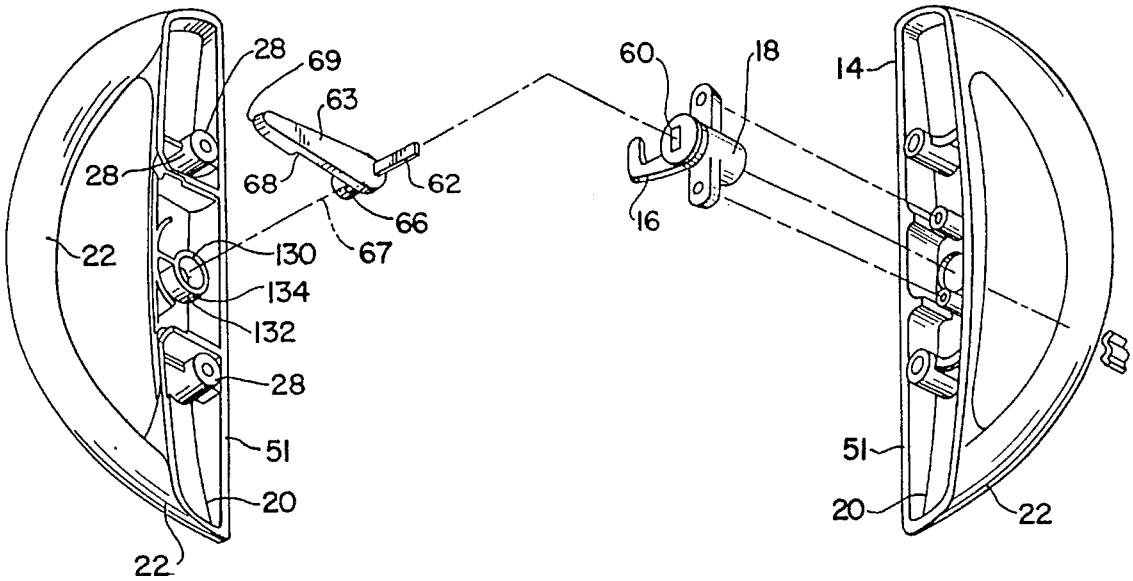
FIG. 5
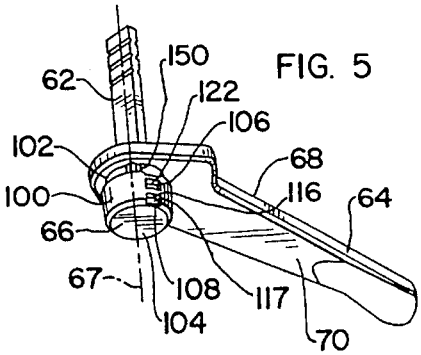
FIG. 6
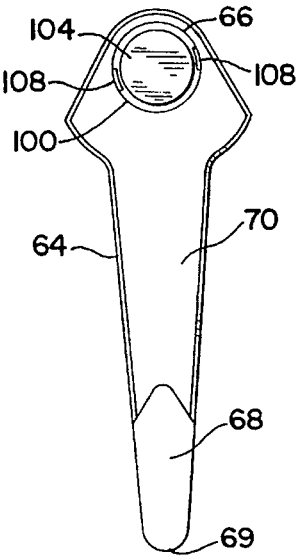
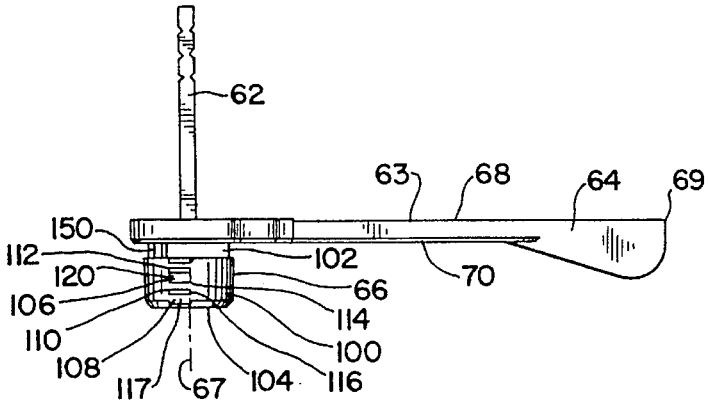
FIG. 7

LATCH ASSEMBLY AND MANUFACTURING AND PAINTING PROCESSES

BACKGROUND OF THE INVENTION

1. Field of the Invention

The present invention relates to latch assemblies, and more particularly to door handle assemblies and thumb turns provided on such assemblies for manual operation of the door's latching mechanism, and to processes for painting and manufacturing such assemblies.

2. Description of the Prior Art

Latch and door handle assemblies are well known, as are those that employ a thumb turn on the interior side of the door handle so that the door locking mechanism may be manually latched or unlatched by moving the thumb turn. Such thumb turns may take the form of lever arms that can be pivoted between the latched and unlatched positions. In manufacturing such door assemblies, and in particular in painting them during the manufacturing process, it is necessary to also paint the lever arm of the thumb turn. To reduce costs for painting operations, it is often advantageous to paint components as an assembly rather than separately. For example, if components are painted as an assembly, labor costs can be saved from less hanging and removing of parts from paint racks. However, unless the lever arm is held in its position of maximum exposure when it is painted, there are likely to be areas of the lever arm that are masked by other parts of the assembly during painting, resulting in unsightly areas missing paint when the manufacturing process is completed. And because typical thumb turns can be pivoted, it is difficult to paint the lever arm because the lever arm may move out of this position of maximum exposure during painting, resulting in visible unpainted areas on the finished product.

In addition, if the thumb turn is painted as an assembly with the base or body, the paint may bridge between the lever surface and the base, creating bumps which are not only unsightly but also can interfere with smooth operation of the thumb turn once installed. Further, breaking dried paint bridges can result in uneven coverage of the components, leaving some spots with minimal protection against corrosion, a particular drawback given the long expected life of such assemblies.

Moreover, thumb turns are typically held to the base with a fastener or backplate. To eliminate or reduce droop of the thumb turn in its uppermost and lowermost positions, components such as springs have usually been required. If the need for some of these parts in the assembly could be eliminated, other cost reductions could be realized.

SUMMARY OF THE INVENTION

In one aspect of the present invention, a latch assembly is provided, including a latch pivotable about an axis between open and closed positions, a body having a plurality of resilient arms having free hook ends circumferentially spaced about the axis, and a thumb turn operably connectable to the latch to pivot the latch between open and closed positions. The thumb turn includes a cylindrical boss, a groove associated with the boss and operably engageable with the arm hook ends for pivotally securing the boss to the body, and a lever arm extending radially outwardly from the cylindrical boss. The lever arm is manually engageable on an outer end extending outside of the body.

In a preferred form of this embodiment, the cylindrical boss further includes a pair of recessed pockets spaced between the groove and the boss end, and the free hook ends of the cantilever arms are receivable in the pockets to limit pivoting of the lever thumb turn relative to the body during painting.

In another aspect of the present invention, a door handle assembly is provided, including an interior handle having a base with a plurality of ribs and resilient cantilever arm extending outwardly from the base to cooperatively define a chamber cylindrical about an axis. A thumb turn for manual operation of a latch includes a cylindrical boss receivable in the cylindrical chamber and having an outer circumferential groove. The resilient arms include free hook ends engageable in the groove to secure the thumb turn for free pivotal movement about the axis relative to the handle base. The thumb turn further includes a lever arm extending radially outward from the cylindrical boss to an end outside of the base, and a latch control post extending along the pivot axis and engageable with the latch for controlling movement of the latch.

In still another aspect of the present invention, the boss has a pair of pockets in its outer cylindrical surface and between the groove and the boss end face. The free hook ends of the cantilever arms being temporarily receivable in the pockets to secure the thumb turn with the maximum area of the lever arm exposed outside of the base, and spaced from the base, for painting.

In yet another aspect of the present invention, a process of assembling a device having a member pivotally secured to a base is provided, including the steps of (1) securing a cylindrical boss of the member to the base, the boss having first and second axially spaced securing means selectively engageable with resilient tabs on the base, where the boss is first temporarily secured to the base by engagement of the tabs with the first securing means with the member secured from pivoting with an exposed area spaced from the base, (2) painting the base and member, (3) allowing the paint to dry, and (4) moving the boss relative to the base to engage the tabs with the second securing means, the second securing means permitting pivotal movement of the member relative to the base.

The present invention addresses the need for a time and expense-saving method of making and painting door handle assemblies that employ pivotable thumb turns, and more specifically, to the need for a structure that will allow for the expeditious manufacture and painting of such assemblies. The present invention provides a structure that temporarily holds the lever arm of the thumb turn fully extended in the position of maximum exposure, so that the largest possible exposed area of the thumb turn may be quickly and easily painted. In addition, the structure of the present invention holds the lever arm spaced away from the base to prevent the problem of bridging of paint. The structure that so holds the lever arm is part of both the door handle assembly and the thumb turn, as manufactured, and holds the thumb turn in this position temporarily: the structure is readily inactivated after painting, with no waste, simply by pushing the thumb turn into its permanent position, where the thumb turn is fully functional and smoothly rotatable. Moreover, the structure of the present invention eliminates any need for additional equipment or change in existing equipment for holding the door handle assembly during painting.

The present invention provides a further advantage in use. Instead of using separate springs or other structures to reduce droop in the lever arm, a pair of detents are used in combination with hooks, that is, horizontal ends, of two cantilevered spring-action arms, arms that serve multiple functions, holding the thumb turn in place during painting and during use. Using the structures of the arms in combination with the thumb turn structure to create a snap fit to hold the thumb turn on the base, the number of parts is reduced since no separate fastener or backplate is needed, further reducing the cost of the thumb turn. Moreover, such a system of detents could be used as an alternative to the anti-bridging structure to hold the thumb turn in the position of maximum exposure, such as by, for example, providing breakable pins instead of or in addition to the detents.

BRIEF DESCRIPTION OF THE DRAWINGS

FIG. 4 is an exploded view of both the interior and exterior sides of the door handle, showing the locking and latching mechanisms as well as the thumb turn of the present invention.

FIG. 5 is a perspective view of the thumb turn or pivoting member of the present invention.

FIG. 6 is a bottom plan view of the thumb turn of FIG. 5.

FIG. 7 is a side view of the thumb turn of FIG. 5.

DETAILED DESCRIPTION OF THE PREFERRED EMBODIMENT

Figure 1:
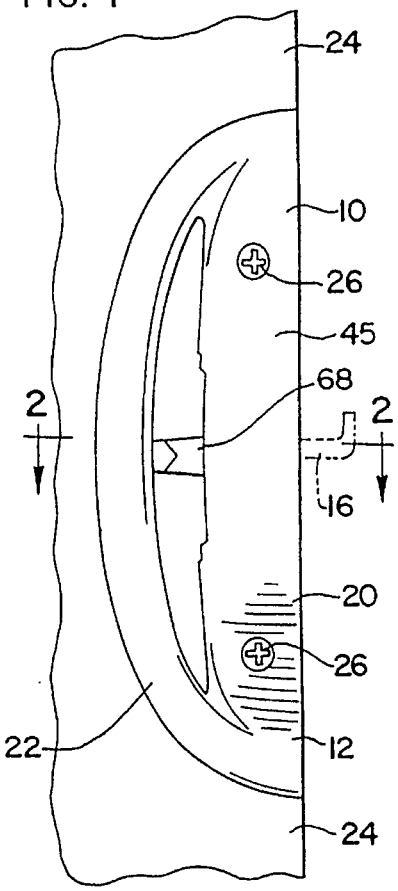
FIG. 1 is a partial front elevation of the interior side of a door handle assembly with which the present invention may be used, in place on a door, with a latch mechanism shown in phantom.
Figure 3:
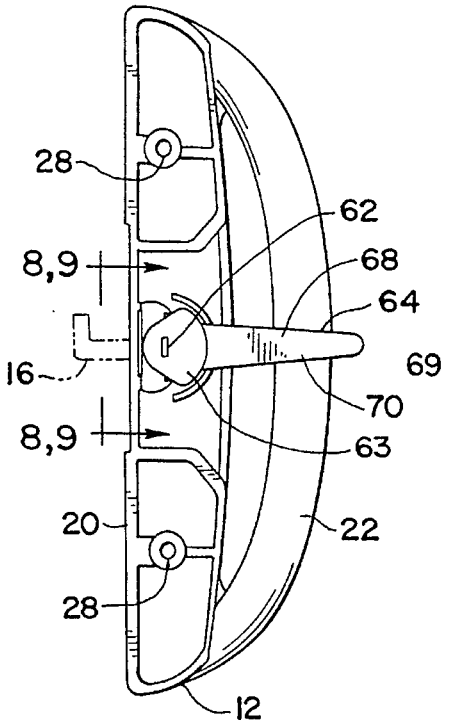
FIG. 3 is a bottom plan view of the interior part of the door handle of FIG. 1, removed from the door, with the latch mechanism shown in phantom, and showing the thumb turn of the present invention in place on the body of the interior part of the door handle.

The structure of the present invention, illustrated in the accompanying drawings, may be useful in providing time and expense saving manufacturing and painting processes for a variety of latch or door handle assembly structures. It is shown with reference to one type of door handle assembly that is useful in providing a low profile door handle for use with, for example, sliding doors, and is more fully disclosed in a patent application entitled "Low Profile Door Handle Assembly," filed concurrently herewith by Marcia K. Blom and commonly assigned to Truth Hardware Corporation. The latch assembly and processes of the present invention, or aspects of them, may also be useful with the invention or aspects of the invention disclosed in the patent application entitled "Thumb Turn With Temporary Pin" filed concurrently herewith by Raul Padilla, Jr. and also assigned to Truth Hardware Corporation, and the disclosure of that patent application may also find utility with aspects of the present invention. Reference is also made to U.S. patent application Ser. No. 29/041,277, filed Jul. 11, 1995 by Marcia K. Blom entitled "Patio Door Handle" and assigned to Truth Hardware Corporation. The complete disclosures of all three of these patent applications are fully incorporated by reference herein. It should be understood that the present invention is, however, useful in other door handle assemblies, and is useful in other latch assemblies and other manufacturing and painting processes and in making other products where it is necessary to paint a pivoting member.

An illustrative door handle, or latch assembly 10 with which the present invention is useful is illustrated in the accompanying FIGS. 1–12, and is provided for purposes of illustration only. The illustrated door handle assembly 10 has an interior part 12 and an exterior part 14, a latch mechanism 16 and a lock mechanism 18 on the exterior part 14 of the assembly 10. Both the interior and exterior parts include bodies 20 and handle portions 22.

Figure 2:
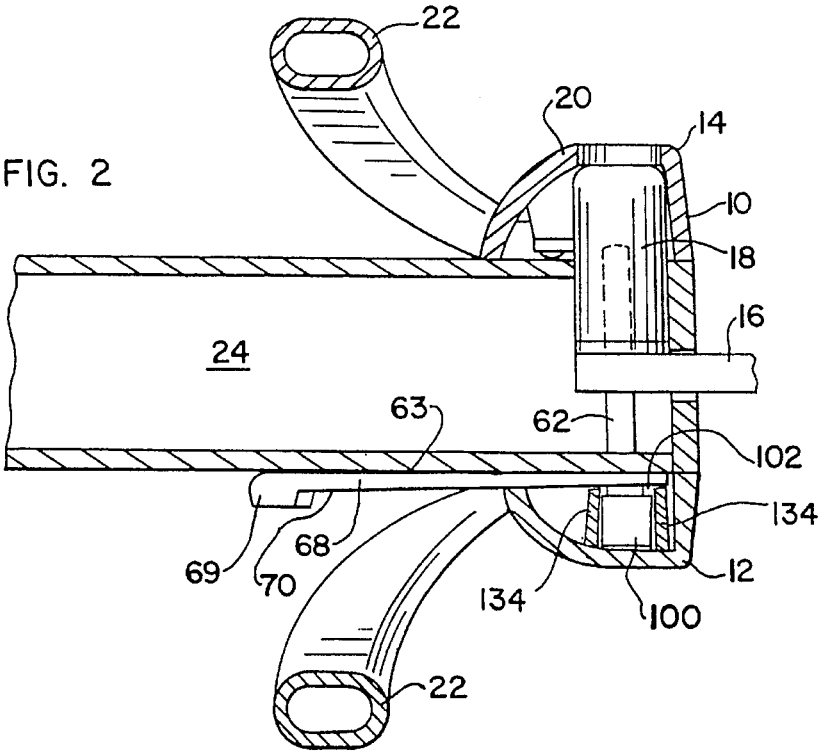
FIG. 2 is an enlarged cross-section, taken along line 2—2 of FIG. 1.

The interior part 12 may be mounted on the inside of a door 24 with screws 26 extending through bosses 28 in the interior part 12, through apertures in the door 24, and into threaded receiving bosses in the exterior part 14, the exterior part 14 being mounted on the outside of the door. As shown in FIG. 2, part of the latch mechanism 16 is held within an opening in the core of the door, and extends out the edge of the door to latch onto a mating structure (not shown) on the door frame (not shown).

As shown in FIG. 2 and 4, a typical door handle assembly includes a lock mechanism 18 that is held partially in an aperture within the door 24 between the exterior 14 and the interior 12 parts of the door assembly 10. As will be understood by those skilled in the art, the lock mechanism is generally operable from the exterior part 14 of the door handle assembly by use of a key (not shown). The lock mechanism 18 is operably connected to the latch mechanism so that the latch mechanism can be operated by operating the lock mechanism.

In the illustrated embodiment, the latch mechanism 16 includes a rectangular aperture 60 exposed toward the interior part 12 of the door handle. As shown in FIG. 4, in the illustrated embodiment, this rectangular aperture 60 is provided to receive a rectangular latch control post 62 extending perpendicularly outward from one face 63 of a thumb turn 64. In the illustrated embodiment, the rectangular latch control post 62 operably connects the latch mechanism 16 to the thumb turn or pivoting member 64 so that the latch mechanism may be moved between its open and closed positions by pivotal movement of the thumb turn. The rectangular latch post thus comprises one form of a means for moving the latch when the thumb turn is pivoted, although it should be understood that the thumb turn of the present invention may be used in conjunction with other structures that coordinate pivoting of the thumb turn with movement of the latch into and out of the latched positions; for example, any other mating shapes of post and aperture may be used in place of the illustrated rectangular shape.

The thumb turn 64 of the present invention also includes a cylindrical boss 66 or pivot post that has a central axis of rotation 67 that is coaxial with the longitudinal axis of the rectangular post 62. The thumb turn also includes a lever arm 68 that may be operated to pivot the thumb turn about the axis of rotation to thereby operate the latch. Thus, movement of the latching part may be controlled by pivoting the lever arm 68.

The lever arm 68 extends radially outwardly from the rotational mounting of the thumb turn in the body of the interior part 12 of the assembly 10 and out past the body to terminate in a free end 69. Thus, parts of the lever arm, including the free end, and parts of the flat face 70 at the juncture of the lever arm and the cylindrical boss and the opposite parallel face 63 of the lever arm, from which the latch control post 62 extends, are exposed outside of the body. When in the position shown in FIGS. 1 and 3, the lever arm 68 is fully extended, with maximum exposure outside of the interior part 12, and minimal masking by other parts of the assembly, and the entire exposed area of the lever arm is available for painting with, for example, a spray painting apparatus. When the lever arm 68 is pivoted downward or upward, the exposed area of the surface of the lever arm decreases to a minimum when the lever arm is in the position shown in FIG. 12.

The cylindrical boss 66 has an outer cylindrical surface 100 and a circumferential groove 102 near the juncture of the cylindrical boss 66 and the lever arm 68 of the thumb turn 64. The diameter of the circumferential groove 102 is less than the diameter of the outer cylindrical surface 100 of the boss 66. The cylindrical boss has a free end face 104 opposite the lever arm 68 and a pair of diametrically opposed pockets 106 disposed between the free end face 104 and the circumferential groove 102. The pockets 106 are recessed from the outer cylindrical surface 100 of the boss 66.

The cylindrical boss 66 also has a pair of vertical grooves 108, each vertical groove being positioned between the corresponding pocket 106 and the free end face 104 of the cylindrical boss 66, the vertical grooves being recessed from the outer cylindrical surface of the cylindrical boss. The vertical grooves may commence at the free end face of the cylindrical boss, as shown in FIGS. 5 and 7. In the illustrated embodiment, the vertical grooves and pockets are diametrically opposed, as shown in FIG. 6.

Figure 10:
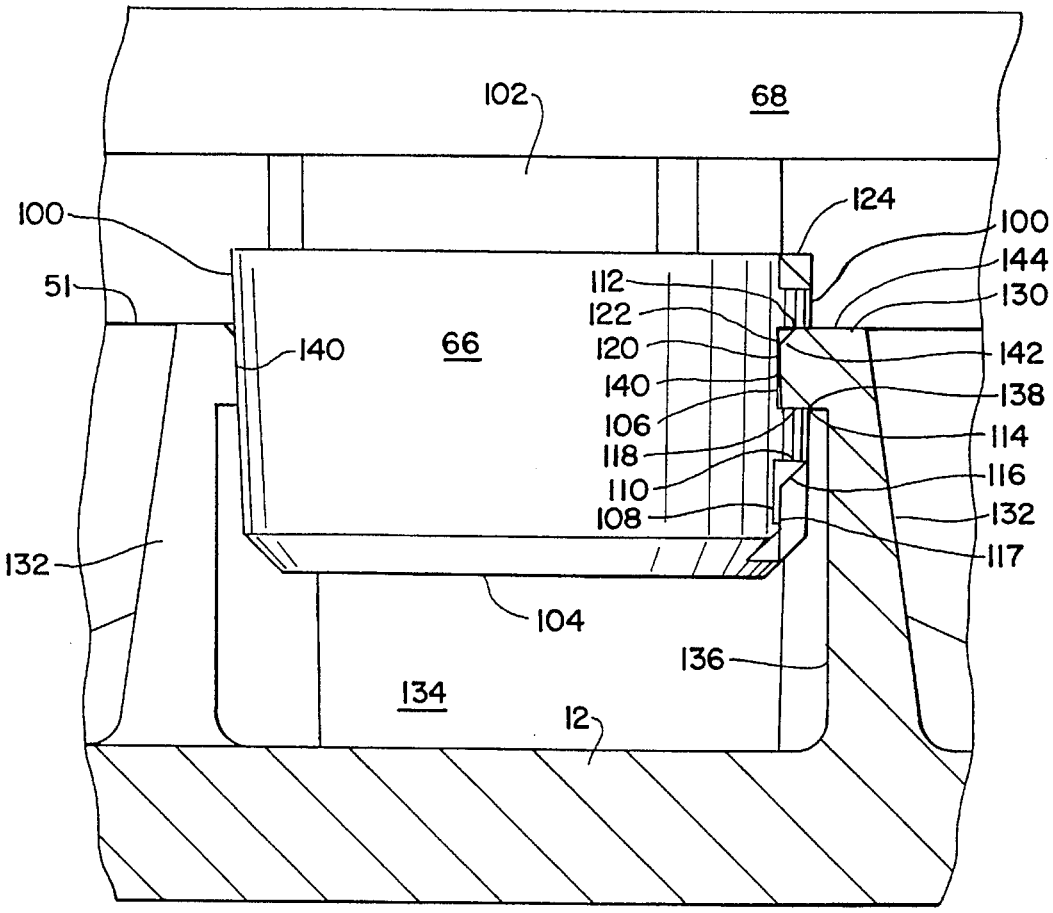
FIG. 10 is a partial enlarged detail of the structure of FIG. 8.

As best seen in FIG. 10, each vertical groove 108 has an upper edge 110 and each pocket has a top edge 112 and a bottom edge 114, all of the edges being at the outer cylindrical surface of the boss. Each vertical groove 108 has a ramped surface 116 leading from the recess 117 to the upper edge 110 of the vertical groove. Each pocket 106 has a flat horizontal surface 118 leading from the recess 120 to the bottom edge 114 and each pocket has a ramped surface 122 leading from the recess 120 to the top edge 112. In the illustrated embodiment, an additional ramped surface 124 leads from the outer cylindrical surface 100 to the circumferential groove 102.

The vertical grooves 108, pockets 106 and circumferential groove 102 all are sized to accept the free hook or horizontal ends 130 of a pair of cantilever arms (or tabs) 132 that extend outwardly from and are connected at one end to the underside of the body 20 of the interior part 12. In the illustrated embodiment, the cantilever arms 132 are diametrically opposed, and the free hook or horizontal ends face inwardly toward one another. The illustrated cantilever arms are separated by ribs 134 which also extend outwardly from the underside of the body 20.

Figure 11:
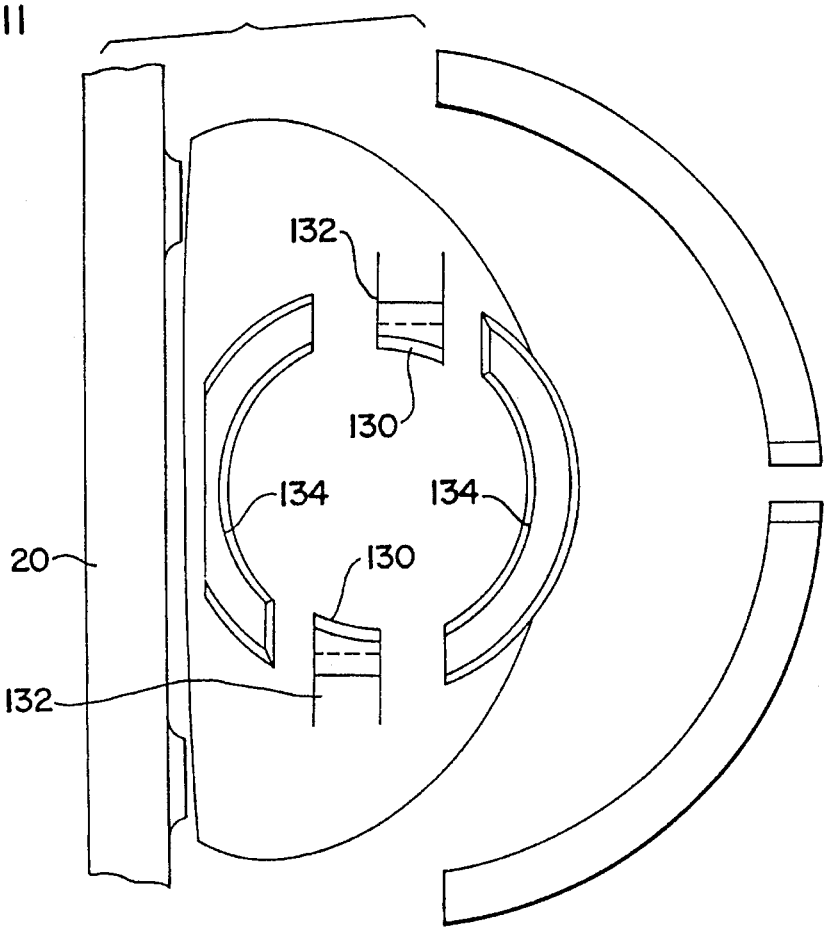
FIG. 11 is a partial enlarged bottom plan view of the mounting members of the body of the interior part of the door handle assembly of the present invention, without the thumb turn.

The cantilever arms 132 are resilient and have vertical sides 136 and inwardly facing bottom horizontal ledges 138 at their free hook or horizontal ends 130 terminating in opposing vertical faces 140. The distance between the opposing vertical faces 140 is less than the distance between the vertical sides. The free hook or horizontal ends of the cantilever arms also have ramped faces 142 extending from the vertical faces 140 to top horizontal ledges 144. As shown in FIG. 11, both the vertical and ramped faces 140, 142 of the free ends 130 of the cantilever arms 132 are curved to match the curve of the circumferential groove 102 of the cylindrical boss 66.

Figure 9:
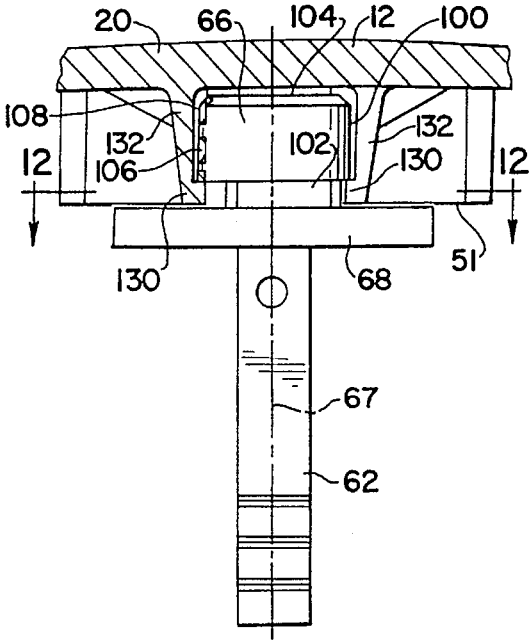
FIG. 9 is a cross-sectional view, taken along line 9—9 of FIG. 3, of the thumb turn of the present invention mounted on the body of the interior part of the door handle and in its final functional position.
Figure 12:
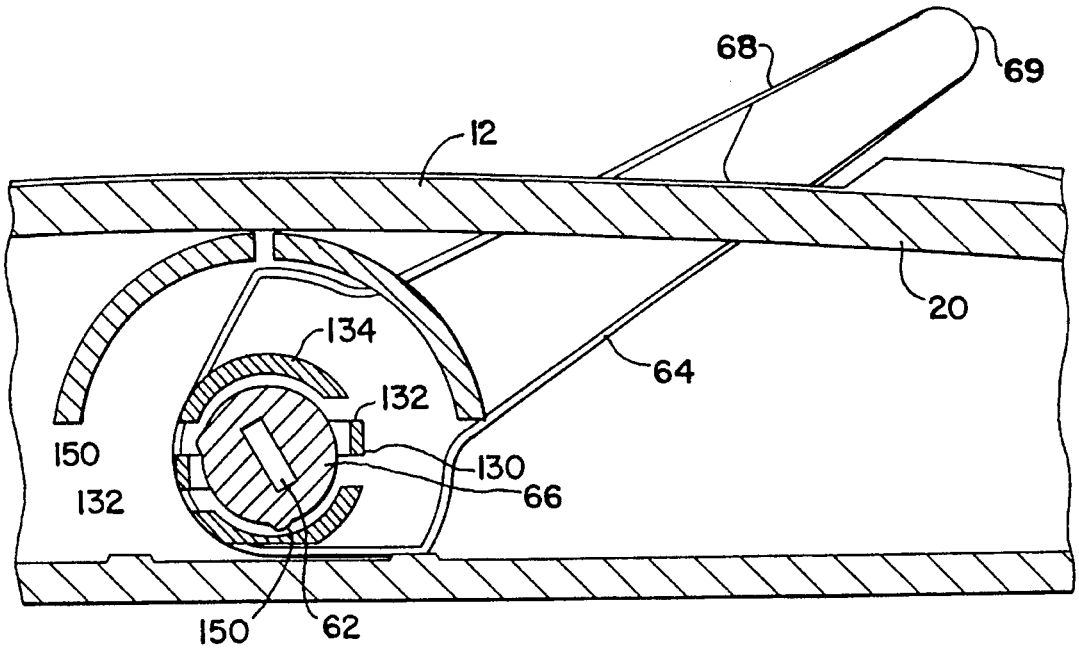
FIG. 12 is a cross-sectional view of the thumb turn in position on the body of the interior part, taken along line 12—12 of FIG. 9, showing the detents of the thumb turn.

In the illustrated embodiment, the cantilever arms 132 cooperate with the ribs 134 to hold the cylindrical boss 66 in the body while allowing for free rotation of the cylindrical boss and latch control post 62 about the central axis of rotation 67 with pivotal movement of the lever arm 68 to move the latch 16 between the open and closed positions. As seen in FIGS. 4 and 12, the ribs 134 provide a partial cylindrical inner surface, of slightly larger diameter than the outer cylindrical surface of the boss 66 to partially surround the boss. The cantilever arms 132 are spaced between the ribs to substantially complete the cylindrical enclosure for the boss, although leaving some gap between the ribs and the cantilever arms as shown in FIG. 11. The free hook or horizontal ends 130 of the cantilever arms 132 engage or are received in the circumferential groove 102 of the cylindrical boss 66 to hold the boss in position in the mounting member defined by the ribs and arms while allowing for free rotational movement of the boss. Because the cantilever arms are resilient, the free hook or horizontal ends tend to stay within the circumferential groove; that is, the resilient spring action of the cantilever arms maintains them in the circumferential groove, as shown in FIG. 9, the permanent functional position for the thumb turn 64 on the body 20. In the permanent functional position, the ribs keep the boss 66 centered on the axis 67 and the hooks 130 prevent the boss 66 from moving along the axis 67, while allowing for rotation or pivoting about the axis. In the illustrated embodiment the circumferential groove extends around the entire boss, although a shorter groove could be provided for a shorter path of motion.

Figure 8:
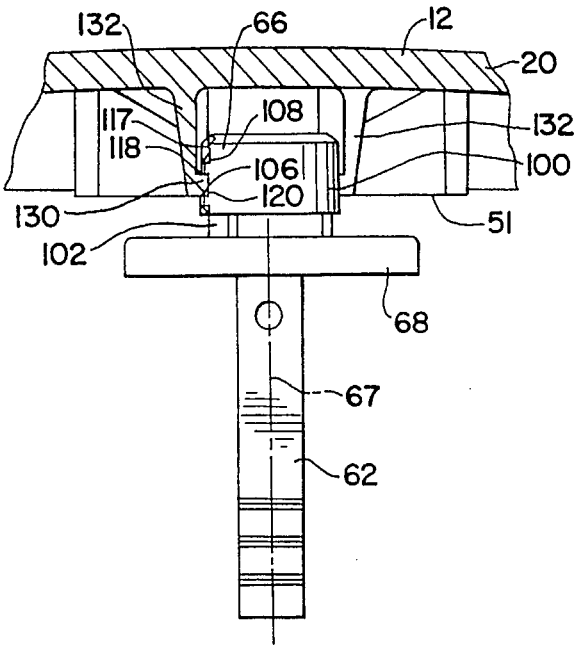
FIG. 8 is a cross-sectional view, taken along line 8—8 of FIG. 3, of the thumb turn of the present invention mounted on the body of the interior part of the door handle and in its temporary position for painting.

A second, temporary position is also provided for the thumb turn on the body, one in which the thumb turn is held away from the body to prevent bridging during painting and held in the position of maximum exposure, where pivoting or rotation about the axis is prevented. This second position is shown in FIG. 8. There, the free hook or horizontal ends 130 of the cantilever arms 132 are held in the pockets 106, the pockets and free hook or horizontal ends being sized, shaped and disposed so as to be capable of receiving the free hook or horizontal ends of the cantilever arms, the sizes and shapes being complimentary so that when the free hook or horizontal ends are received in the pockets as shown in FIG. 8, rotation of the cylindrical boss and pivoting of the lever arm is prevented or at least substantially limited. As shown, when the free hook or horizontal ends are in the pockets, the thumb turn cannot rotate, so the piece can be painted.

The vertical grooves 108 serve to guide the free hook or horizontal ends 130 of the cantilever arms 132 into the recesses of the pockets 106. The grooves are sized and shaped to receive the free hook or horizontal ends and vertical sides of the cantilever arms, and the ramped faces of the free hook or horizontal ends will travel up the ramped surfaces 116 of the vertical groove until the hook ends snap into the recesses 120 of the pockets. Once there, the flat horizontal surface 118 of the pocket will limit the ability of the free ends to slip back out of the pocket.

As shown in FIG. 8, the pockets should be spaced from the lever arm a distance sufficient to hold the lever arm a sufficient distance from the outer edge 51 around the perimeter of the body to prevent bridging of paint. Thus, the thumb turn is temporarily held in the position shown in FIG. 8, where the maximum area of the lever arm is exposed outside of the body for painting, where unwanted movement out of this position is limited or prevented, and where the lever arm is held at a greater distance from the body than in use.

When painting is complete and the paint has dried sufficiently, the thumb turn may be easily moved to its permanent functional position shown in FIG. 9 simply by pushing the thumb turn further into the body 20. The ramped faces 142 on the free hook ends 130 will travel up the ramped surface 122 leading from the pocket recess 120 to the outer cylindrical surface of the boss, and then down the final ramped surface 124 and into the circumferential groove, where the free end remains until some step is taken to remove the thumb turn from the body.

To prevent the thumb turn from drooping in use, the present invention provides a pair of detents 150 on the circumferential groove 102. As shown in FIG. 12, each detent 150 is a bump that slightly expands the diameter of the circumferential groove, and which works against the spring action of the cantilever arms 132 as the lever arm 68 is pivoted. In the illustrated embodiment, the detents or bumps 150 are positioned so that they must be rotated past the free ends of the cantilever arms as the lever arm is rotated out of its two extreme positions. Thus, the illustrated detents serve to limit the pivotal movement of the lever arm when the latch is in the open and closed positions. The positions of the detents may be varied depending on the end use.

In the processes of the present invention, such a latching assembly can be made by providing such an assembly and placing the boss of the thumb turn in the mounting area so that the free hook ends of the boss are held within the pockets and the free end of the lever arm is held outside of the body. The combined part may then be painted and allowed to dry. Then, the thumb turn boss may be pushed further into the mounting area of the body so that the free hook ends of the cantilever arms are positioned in the circumferential groove. If vertical grooves are provided in the boss as described, then the step of placing the boss of the thumb turn in the mounting area so that the free hook ends are held within the pockets of the boss includes the step of placing the free hook ends of the cantilever arms in the vertical grooves and pushing the boss into the body until the free hook ends engage the pockets. This process may be used for painting other products that have a pivoting member as well.

In the process of the present invention, an assembly may be painted following the steps of first providing an assembly comprising a pivoting member, such as the thumb turn 64, and a body, such as the interior part 12 body 20, with a mounting area for pivotally mounting the pivoting member in the body, such as the mounting area provided by the combination of the ribs 134 and cantilever arms 132, the pivoting member having an exposed area outside of the body when mounted in the body, such as the exposed surface of the thumb turn. The pivoting member is temporarily mounted on the body at a first position wherein the pivoting member is prevented from pivoting and wherein the exposed area is spaced from the body, such as the position shown in FIG. 8, and the combined pivoting member and body may be painted with the pivoting member maintained at the first position. As illustrated in FIGS. 8 and 9, the distance between the exposed area and the body in the first position is greater than the distance between the exposed area and the body when the pivoting member is pivotally mounted on the body. The step of temporarily mounting the pivoting member may comprise the step of inserting a plurality of hooks, such as the horizontal ends 130 of the cantilever arms 132, into the pivoting member to limit movement of the pivoting member. When the painting process is part of a manufacturing process, the method may further comprise the step of moving the pivoting member to a final position wherein the pivoting member is closer to the body than when at the first position and wherein the pivoting member is pivotable, such as by moving the pivoting member to the position shown in FIG. 9. When hooks such as the horizontal ends of the cantilever arms are used, this step of the manufacturing process may involve removing the hooks from the pivoting member, such as by pushing the pivoting member down into the body in the illustrated embodiment, so that the pivoting member is fully received into the mounting area.

While the present invention has been described in terms of illustrated embodiments, many of the innovative features of the invention disclosed could be utilized apart from the totality of features disclosed and hence would still fall within the spirit and scope of this invention. Therefore, although certain alternative and modified approaches or aspects have been disclosed or suggested herein, it also should be understood that various modifications, changes and variations may be made in the arrangement, operation and details of construction of the elements disclosed herein without departing from the spirit and scope of this invention.

I claim:

1. A latch assembly comprising:

a latch pivotable about an axis between open and closed positions;

a body including a plurality of resilient arms having free hook distal ends circumferentially spaced about the axis, the resilient arms extending outwardly to the distal ends from the body in a direction substantially parallel to the axis; and a thumb turn operably connectable to the latch to pivot the latch between open and closed positions, the thumb turn including a cylindrical boss means associated with said boss and operably engageable with said arm hook ends for pivotally securing said boss to said body, and a lever arm extending radially outwardly from the cylindrical boss, said arm being manually engageable on an outer end extending outside of the body.

2. The latch assembly of claim 1 wherein the resilient arms are connected at one end to the body and the free hook ends are at the other arm ends, said hook ends including projections extending substantially perpendicular to said axis.

3. The latch assembly of claim 1 wherein the body includes plurality of ribs that along with the resilient arms define a substantially cylindrical opening to receive the boss, the plurality of ribs extending from the body to partially surround the cylindrical boss when secured to said body.

4. A latch assembly comprising:

a latch pivotable about an axis between open and closed positions;

a body including a plurality of resilient arms having free hook ends circumferentially spaced about the axis; and a thumb turn operably connectable to the latch to pivot the latch between open and closed positions, the thumb turn including a cylindrical boss having an outer cylindrical surface with a circumferential groove wherein the free hook ends of the resilient arms are received in the circumferential groove, and a lever arm extending radially outwardly from the cylindrical boss, said arm being manually engageable on an outer end extending outside of the body.

5. The latch assembly of claim 4, further comprising a detent outstanding from the circumferential groove, said detent engaging the free hook end of one resilient arm when the thumb turn is in a preselected operable position.

6. The latch assembly of claim 5 wherein the detent passes the free hook end of the one resilient arm when the thumb turn is pivoted to its open position.

7. The latch assembly of claim 5 wherein the detent inhibits pivotal movement of the thumb turn when the latch is in the open position.

8. The latch assembly of claim 7 further comprising a second detent outstanding from the circumferential groove, wherein the second detent engages the free hook end of one of the resilient arms to inhibit pivotal movement of the thumb turn when the latch is in the closed position.

9. A latch assembly comprising:

a latch pivotable about an axis between open and closed positions;

a body including a plurality of resilient arms having free hook ends circumferentially spaced about the axis; and a thumb turn operably connectable to the latch to pivot the latch between open and closed positions, the thumb turn including a cylindrical boss having an end face, means associated with the boss and operably engageable with the arm hook ends for pivotally securing the boss to the body, said means being axially Spaced from the boss end face, a pair of recessed pockets spaced between the securing means and the end face, the free hook ends of the resilient arms being receivable in the pockets to limit pivoting of the lever thumb turn relative to the body during painting, and a lever arm extending radially outwardly from the cylindrical boss, the arm being manually engageable on an outer end extending outside of the body.

10. The latch assembly of claim 9 wherein the cylindrical boss has axial grooves in the end face and axially aligned with each of the pockets.

11. The latch assembly of claim 10 wherein the axial grooves and pockets each have a surface ramped to the cylindrical boss periphery at their axial ends spaced furthest from the end face, and said pockets each have a surface substantially perpendicular to said axis at their axial ends closest to the end face.

12. The latch assembly of claim 11 wherein the resilient arms are connected at one end to the body and the free hook ends are at the other arm ends, said hook ends including projections extending substantially perpendicular to said axis and having ramped end faces substantially matching the ramped surfaces of the axial grooves and pockets.

13. The latch assembly of claim 9 wherein the body has an outer edge around its perimeter and the lever arm is spaced from said edge when the free hook ends of the cantilever arms are received in the pockets.

14. The latch assembly of claim 13 wherein the pockets and body resilient arms are positioned whereby a maximum extent of the lever arm extends outwardly beyond the body edge for painting when the free hook ends of the arms are received in the pockets.

15. A door handle assembly comprising:

an interior handle having a base with a plurality of ribs and resilient cantilever arm extending outwardly from the base to cooperatively define a chamber cylindrical about an axis, each of said arms free hook ends;

a latch moveable between open and closed positions;

a thumb turn for manual operation of the latch, the thumb turn including a cylindrical boss receivable in the cylindrical chamber and having an outer circumferential groove, said free hook ends being engageable in said groove to secure said thumb turn for free pivotal movement about said axis relative to said handle base, a lever arm extending radially outward from the cylindrical boss to a free end spaced from the cylindrical boss and exposed outside of the base, and a latch control post extending along said axis and fixed for pivoting with the boss, said control post being engageable with the latch for controlling movement of the latch.

16. The door handle assembly of claim 15 wherein the cylindrical boss has an outer cylindrical surface and an end face axially spaced from the groove and further includes a pair of recessed pockets in the cylindrical surface between the groove and the end face, the free hook ends of the cantilever arms being temporarily receivable in the pockets to secure the thumb turn with the maximum area of the lever arm exposed outside of the base, and spaced from the base, for painting.

17. The door handle assembly of claim 16 wherein the cylindrical boss has a pair of axial grooves in the end face and axially aligned with the pair of pockets to guide the hook ends of the cantilever arms to the pockets during assembly prior to painting.

18. The door handle assembly of claim 17 wherein the axial grooves and pockets each have a surface ramped to the boss outer cylindrical surface at their axial ends spaced furthest from the end face, and said pockets each have a surface substantially perpendicular to said axis at their axial ends closest to the end face.

19. The door handle assembly of claim 18 wherein the resilient arms are connected at one end to the base and the free hook ends are at the other arm ends, each said hook end including a projection extending substantially perpendicular to said axis and having a ramped end face substantially matching the ramped surfaces of the axial grooves and pockets.

20. The door handle assembly of claim 16 wherein the base has an outer edge around its perimeter and the lever arm is spaced from said edge when the free hook ends of the cantilever arms are received in the pockets.

21. The door handle assembly of claim 15, further comprising a detent outstanding from the circumferential groove, said detent engaging the free hook end of one resilient arm when the thumb turn is in a preselected operable position.

22. The door handle assembly of claim 21 wherein the detent inhibits pivotal movement of the thumb turn when the latch is in the open position.

23. The door handle assembly of claim 22, further comprising a second detent outstanding from the circumferential groove, wherein the second detent engages the free hook end of one of the resilient arms to inhibit pivotal movement of the thumb turn when the latch is in the closed position.

* * * * *